US006818040B1

(12) United States Patent
Sandberg et al.

(10) Patent No.: US 6,818,040 B1
(45) Date of Patent: Nov. 16, 2004

(54) POWDER METALLURGY MANUFACTURED HIGH SPEED STEEL

(75) Inventors: Odd Sandberg, Uddeholm (SE); Leif Westin, Söderfors (SE)

(73) Assignees: Uddeholm Tooling Aktiebolag, Hagfors (SE); Erasteel Kloster Aktiebolag, Soderfors (SE)

( * ) Notice: Subject to any disclaimer, the term of this patent is extended or adjusted under 35 U.S.C. 154(b) by 0 days.

(21) Appl. No.: 09/979,025

(22) PCT Filed: Jun. 15, 2000

(86) PCT No.: PCT/SE00/01247

§ 371 (c)(1),
(2), (4) Date: Nov. 15, 2001

(87) PCT Pub. No.: WO00/79015

PCT Pub. Date: Dec. 28, 2000

(30) Foreign Application Priority Data

Jun. 16, 1999 (SE) ..... 9902262

(51) Int. Cl.[7] ..... B22F 3/00
(52) U.S. Cl. ..... 75/238; 75/246
(58) Field of Search ..... 75/238, 246; 420/10, 420/101

(56) References Cited

U.S. PATENT DOCUMENTS

| | | | | | |
|---|---|---|---|---|---|
| 2,781,259 | A | * | 2/1957 | Roberts | 420/102 |
| 3,929,471 | A | * | 12/1975 | Akahori et al. | 420/10 |
| 4,110,514 | A | * | 8/1978 | Nicholson | 428/683 |
| 4,121,929 | A | | 10/1978 | Kawai et al. | 75/238 |
| 4,140,527 | A | | 2/1979 | Kawai et al. | 75/244 |
| 4,224,060 | A | * | 9/1980 | de Souza et al. | 420/100 |
| 4,964,908 | A | * | 10/1990 | Greetham | 75/241 |
| 5,270,124 | A | * | 12/1993 | Saxby | 428/683 |
| 6,057,045 | A | * | 5/2000 | Wojcieszynski et al. | 428/546 |
| 6,200,528 | B1 | * | 3/2001 | Rodney et al. | 420/10 |

FOREIGN PATENT DOCUMENTS

| | | | |
|---|---|---|---|
| WO | WO 88/07093 | 9/1988 | C22C/33/02 |
| WO | WO 98/40180 | 9/1998 | B22F/1/00 |

OTHER PUBLICATIONS

Copy of International Search Report.
Hirano, M. et al., "Effect of Nitrogen on High Speed Steels," *Metal Powder Report*, vol. 41, No. 7, Jul. 1986, pp. 527–531.

* cited by examiner

*Primary Examiner*—Ngoclan Mai
(74) *Attorney, Agent, or Firm*—Nixon & Vanderhye

(57) ABSTRACT

A powder metallurgy manufactured high speed steel with a high content of nitrogen in the form of a body formed through consolidation of alloyed metal power has the chemical composition in weight-% ; 1–25 C, 1–3.5 N, 0.05–1.7 Mn, 0.05–1.2 Si, 3–6 Cr, 2–5 Mo, 0.05–5W, 6.2–1.7 (V+2 Nb), balance iron and unavoidable impurities in normal amounts, wherein the amount of, on one hand, the carbon equivalent, Ceq, expressed as formula (I), and, on the other hand, the vanadium equivalent, Veq, expressed as Veq=V+2 Nb, are balanced relative to each other such that the amounts of said elements, express in term of said equivalent, will lie within the area A1-B1-C1-D1-A1 in the system of co-ordinates in the figure, in which the Ceq/Veq-co-ordinates of the points A1-D1 are A1: 4.5/17; B1: 5.5/17; C1: 2.5/6.2; D1; 1.5/6.2. The structure of the steel in the hardened and tempered condition, contains 12–40 vol-% of hard matter consisting of particles of MX-type, which are evenly distributed in the matrix of the steel, where M in said hard matter of MX-type essentially consists of vanadium and/or niobium, and X consists of 30–50 weight-% carbon and 50–70 weight-% nitrogen.

46 Claims, 2 Drawing Sheets

POWDER METALLURGY MANUFACTURED HIGH SPEED STEEL

TECHNICAL FIELD

The invention relates to a powder metallurgy manufactured high speed steel with a high content of nitrogen in the form of a body formed through consolidation of alloyed metal powder. The invention particularly relates to a high speed steel suitable for cold work tools intended for applications where the tool is subjected to heavy friction between the working material and the tool resulting in a risk of adhesive wear.

BACKGROUND OF THE INVENTION

Cold work often includes blanking, punching, deep drawing, and other forming of metallic working materials, which usually have the form of sheets or plates, normally at room temperature. For this type of work there are used cold work tools, on which a number of requirements are raised, which are difficult to combine. The tool material shall have a high resistance against abrasive wear, which among other things implies that it hall have an adequate hardness; it shall also have a good resistance against adhesive wear for certain applications; and it shall also have an adequate toughness in its use condition.

For the above and other applications there is to a great extent used a cold work steel which is known under its trade name Sverker 21®, which is a conventionally manufactured steel having the composition 1.55 C, 0.3 Si, 03 Mn, 12.0 Cr, 0.8 Mo, 0.8 V, balance iron and impurities in normal amounts. For cold work tools there is also used the powder metallurgy manufactured tool steel which is known by its trade name Vanadis 4®, which contains 1.5 C, 1.0 Si 0.4 Mn, 8.0 Cr, 1.5 Mo, 4.0 V, balance iron and impurities in normal amounts. Also high speed steels are employed, such as those high speed steels which are known under the trade names ASP®2023 and ASP®2053. The former one has the nominal composition 1.28 C, 4.2 Cr, 5.0 Mo, 6.4 W, 3.1 V, while the latter one has the nominal composition 2.45 C, 4.2 Cr, 3.1 Mo, 4.2 W, 8.0 V, wherein the balance in both the steels is iron, normal amount of Mn and Si and normally existing impurities.

The above mentioned and other steels available on the market place satisfy high requirements on abrasive wear resistance, toughness and other features. However, they do not satisfy high requirements on adhesive wear resistance, which often is a dominating problem in connection with different types of cold forming tool applications, such as pressing of sheets, pipe bending, and cold extrusion. These problems particularly can arise in connection with cold working of sheets of austenitic and ferritic stainless steels, copper, brass, aluminium, and others. The problems can be reduced by lubrication and/or surface coating of the tool surfaces with friction reducing ceramic layers of eg. TiN through PCD or CVD technique, through surface nitriding, or through hard chromium plating, but those are expensive and time consuming problem solutions. In addition, the risk of damages and/or flaking of the depositions is great. If abrasive or adhesive wear damages arise, the repair will be complicated because any defect always will be located on a very stressed part of the tool.

BRIEF DISCLOSURE OF THE INVENTION

It is the purpose of the invention to provide a high speed steel for cold work tools with a very high resistance to adhesive wear in combination with other desirable fires of cold work tools, such as adequate toughness, harness, and resistance to abrasive wear. The steel shall, after pressing the powder to form a consolidated body through hot isostatic compaction (HIP-ing), be able to be hot worked through forging, rolling, and extrusion or be used in the as HIP-ed condition.

These and other objectives can be achieved therein that the high speed steel, with reference to its chemical composition in weight-%

1–2.5 C

1–3.5N 0.05–1.7 Mn 0.05–1.2 Si

3–6 Cr

2–5 Mo 0.5–5 W 6.2–17(V+2Nb)

balance iron and unavoidable impurities in normal amount, wherein the amount of, on one hand, the carbon equivalent, Ceq, expressed as $$Ceq = C + \frac{12}{14}N,$$

and, on the other hand, the vanadium equivalent, Veq, expressed as Ve=V+2 Nb, shall be balanced relative to each other such that the amounts of said elements, expressed in terms of said equivalent, will lie within the area A1-B1-C1-D1-A1 in the system of co-ordinates in FIG. 1, in which Ceq/Veq-co-ordinates of the point A1-D1 are

A1:4.5/17

B1:5.5/17

C1:2.5/6.2

D1 1.5/6.2 and that the high speed steel with reference to its structure, in the hardened and tempered condition of the steel, contain 12–40 vol-% of hard matter consisting of particles of MX-type, which are evenly distributed in the matrix of the steel, M in said matter of MX-type essentially consisting of vanadium and/or niobium, and X consisting of 30–50 weight-% carbon and 50–70 weight-% nitrogen.

In the following, a number of more limited areas will be defined, defining different embodiments and variants of the invention with reference to the relations between carbon equivalent and vanadium equivalent. I the list below, the Ceq/Veq-co-ordinates for all the points which have been indicated in the diagram in FIG. 1 have been stated.

In this text percentages refer to weight-%, unless otherwise is mentioned

| Ceq/Veq-co-ordinates of indicated points in FIG. 1 | | | | |
|---|---|---|---|---|
| A1:4.5/17 | A2:4.6/17 | A3:4.75/17 | B2:5.3/17 | B1:5.5/17 |
| A1':4.35/16.5 | A2':4.45/16.5 | A3':4.6/16.5 | B2':5.15/16.5 | B1':5.35/16.5 |
| A1":4.2/16 | A2":4.3/16 | A3":4.5/16 | B2":5.0/16 | B1":5.2/16 |
| F1":3.8/14.5 | F2":3.9/14.5 | F3":4.05/14.5 | E2":4.6/14.5 | E1":4.8/14.5 |
| F1':3.65/14 | F2':3.75/14 | F3':3.9/14 | E2':4.45/14 | E1':4.65/14 |
| F1:3.55/13.5 | F2:3.65/13.5 | F3:3.8/13.5 | E2:4.35/13.5 | E1:4.55/13.5 |
| F1'":3.25/12.5 | F2'":3.35/12.5 | F3'":3.5/12.5 | E2'":4.05/12.5 | E1'":4.25/12.5 |
| $F1^{IV}$:3.1/12 | $F2^{IV}$:3.2/12 | $F3^{IV}$:3.35/12 | $E2^{IV}$:3.9/12 | $E1^{IV}$:4.1/12 |
| $G1^{IV}$:2.7/10.5 | $G2^{IV}$:2.8/10.5 | $G3^{IV}$:2.95/10.5 | $H2^{IV}$:3.5/10.5 | $H1^{IV}$:3.7/10.5 |
| G1'":2.55/10 | G2'":2.65/10 | G3'":2.8/10 | H2'":3.35/10 | H1'":3.55/10 |
| G1:2.4/9.5 | G2:2.5/9.5 | G3:2.65/9.5 | H2:3.2/9.5 | H1:3.4/9.5 |
| G1':2.27/9 | G2':2.37/9 | G3':2.52/9 | H2':3.07/9 | H1':3.27/9 |
| G1":2.15/8.6 | G2":2.25/8.6 | G3":2.4/8.6 | H2":2.95/8.6 | H1":3.15/8.6 |
| D1":1.85/7.4 | D2":1.95/7.4 | D3":2.10/7.4 | C2:2.65/7.4 | Cl":2.85/7.4 |
| D1':1.75/7 | D2':1.85/7 | D3':2.0/7 | C2':2.58/7 | Cl':2.75/7 |
| D1:1.5/6.2 | D2:1.6/6.2 | D3:1.75/6.2 | C2:2.3/6.2 | Cl:2.5/6.2 |

A number of preferred or conceived embodiments of the invention with reference to the relation between the carbon and vanadium equivalents of the steel within the entire range Veq=6.2–17 (V+2 Nb) are stated in the sub-claims 2–5.

In the following, the election of the different alloy elements and the contents of them will be explained more in detail.

Carbon has two important functions in the steel of the invention. On one hand it shall, together with nitrogen and vanadium and/or niobium, form vanadium and/or niobium carbonitrides; on the other hand carbon shall exist in a sufficient amount in the matrix of the steel in order to provide a desired hardness of the martensite which is obtained after hardening and tempering. More particularly the content of carbon which is dissolved in the matrix should amount to 0.40–0.60%, preferably to 0.47–0.54. From these reasons, carbon shall exist in an amount of at least 1 weight-% and max 2.5 weight-%.

In said hard matter of MX-type, i.e. vanadium and/or niobium carbonitrides, X shall consist of 30–50 weight-% carbon and 50–70 weight-% nitrogen, wherein the ratio weight-% N/weight-% C of the amounts and nitrogen and carbon which are present in said carbonitrides of MX-type shall satisfy the conditions:

$$1.0 \leq \frac{weight\text{-}\%N}{weight\text{-}\%C} \leq 2.3.$$

The amount of nitrogen which exist in the steel in its molten state prior to gas granulation and the amount of nitrogen which is added to the steel by nitriding the gas granulated steel powder, which is the greater part, essentially combine with vanadium and/or niobium to form said carbonitrides. The amount of nitrogen which remains in the matrix of the steel and/or which possibly form nitrides with other existing elements, shall be practically negligible in comparison with the amount of nitrogen in said carbonitrides. For the achievement of the desired carbonitrides of MX-type, the content of nitrogen therefore shall amount to at least 1 weight-% and max 3.5 weight-%.

Silicon exists in an amount of at least 0.05, preferably at least 0.1% as a residual product from the deoxidation of the steel melt and can be tolerated in amounts up to 1.7%, preferably max 1.2%, normally max 0.7%.

Manganese exists in an amount of at least 0.05%, preferably at least 0.1%, in the first place as a residual product from the melt metallurgical process technique, where manganese is important in order to make sulphur compounds harmless through the formation of manganese sulphides in a manner known per se. The maximally tolerated manganese content is 1.7%, preferably max 1.0%, normally max 0.5%.

Chromium shall exist in the steel in an amount of at least 3%, preferably at least 3.5%, in order to contribute to the achievement of a sufficient hardenability of the matrix of the steel. Too much chromium, however, may cause a risk of retained austenite which is difficult to transform, and formation of $M_7C_3$-carbides, which are less desired. The chromium content therefore is limited to max 6%, preferably max 5%, and desirably max 4.5%.

Molybdenum and tungsten shall exist in the steel in order to provide a secondary hardening during tempering and to give a contribution to the hardenability. The limits are chosen such that the said elements, adapted to other alloy elements, shall provide an optimal hardness after hardening and tempering and also provide a small amount of hard $M_6C$-particles. Molybdenum should exist in an amount of at least 2%, preferably at least 2.5% and suitably at least 3.0%. Tungsten should exist in an amount of at least 0.5% preferably in an amount of at least 2.0%, and suitably at least 2.5% and most conveniently at least 3.0%. The contents of each of molybdenum and tungsten, should not exceed 5% preferably not exceed 4.0%. As far as molybdenum and tungsten are concerned, the expression $$Mo_{eq} = Mo + \frac{W}{2}$$

should lie in the range 2.25–7.5%, preferably within the range 4–6%. The content of $M_6C$-carbines, where M substantially consists of molybdenum and tungsten, should totally amount to 3.5 vol-% or to 10–30% of the total volume content of ($MX+M_6C$)-phase.

Vanadium shall exist in the steel in a lowest amount of 6.2% and max 17% in order, together with carbon and nitrogen, to form very hard vanadium carbonitrides, i.e. hard matter of MX-type, where M essentially is vanadium and X is carbon and nitrogen in the weight ratios which have been mentioned in the foregoing. Possibly, vanadium may entirely or partially be replaced by niobium. The maximally allowed niobium content is 1.0%, preferably max 0.5%. Suitably, however, the steel does not contain any intentionally added niobium, because that can make the scrap handling in a steel work more complicated but above all because niobium might cause an impaired toughness of the steel because of a more unfavourable, more edgy carbide structure than a typical vanadium carbonitride of MX-type.

As has been mentioned in preamble, it is a purpose of the invention in the first place to provide a new high speed steel suited for cold work tools. Because cold work steels shall be able to be used at room temperature, the steel advantageously should not contain cobalt which is expensive and can make the steel less tough. According to a conceivable aspect of the invention, however, the steel should also be possible to be employed for working at high temperatures, in which case cobalt might be included in amounts up to max 20%, preferably max 12%. For the in the fist place intended field of use—cold work steels—the steel, however, should not contain cobalt in amounts higher than those impurity contents which normally occur as residual elements from the raw material which are used in steel works which manufacture high speed steels, i.e. max 1% cobalt, preferably max 0.5% cobalt.

According to a first variant of the invention, the vanadium content shall be 6.2–9.5%. This implies, according to the widest aspect on this first variant, that the co-ordinates of the carbon and vanadium equivalents shall lie within the area G1-H1-C1-D1-G1 in the system of co-ordinates in FIG. 1.

Limiting aspects on this first variant are stated in the subsequent claims 7–12. Within the frame of the most limited aspect on this first variant is a steel having the following preferred, nominal composition: 1.3 C, 1.4 N, (Ceq about 2.5) 0.5 Si, 0.3 Mn, 4.2 Cr, 3.0 Mo, 4.0 W. 8.0 V, balance iron and normally existing impurities. Such a steel can be employed for most of the mentioned fields of use for which the steel is intended.

According to a second variant of the invention, the steel shall contain 13.5–17 (V+2 Nb). This implies, according to the widest aspect on this variant, that the co-ordinates of the carbon and vanadium equivalents shall lie within the area A1-B1-E1-F1-A1 in the system of co-ordinates in FIG. 1. Limiting aspects of this second variant are stated in the subsequent claims 14–19. Within the frame of this most limited, preferred composition according to this second aspect is a steel with the following preferred, nominal composition 2.0 C, 3.0 N, (Ceq about 4.6), 0.5 Si, 0.3 Mn, 4.2 Cr, 3.0 Mo, 4.0 W, 15.0 V, balance iron and normally existing impurities. A steel having this composition is particularly suited to be employed for the manufacturing of tools which are subjected to particularly heavy adhesive wear and differs from the foregoing preferred composition by it higher contents of vanadium, carbon, and nitrogen resulting in an about twice as high fraction of MX-phase.

According to a third variant of the invention, the steel shall contain 9.5–13.5 (V+2 Nb), wherein the coefficients of the contents of the carbon and vanadium equivalents lie within the area F1-E1-H1-G1-F1. Limiting aspects of this third variant are stated in the accompanying claims 21–26. Within the frame of this most limited, preferred composition according to this third variant there is a steel having the following preferred nominal composition: 1.5 C, 2.0 N (Ceq about 3.2), 0.5 Si 0.3 Mn, 4.2 Cr, 3.0 Mo, 4.0 W, 11.0 V, balance iron and normally existing impurities. A steel of that kind provides a better hot workability than the highly alloyed steel according to said second variant and also a better wear resistance than the less alloyed steel according to said first variant.

The technical features of the steel can be described as follows:

The steel consists of a powder metallurgy manufactured high speed steel, the alloy composition of which in the first place is distinguished by a high vanadium content. In its delivery condition the steel has a substantially ferritic matrix, which contains a considerable amount of carbonitrides, in the first place vanadium carbonitrides, which are fine-grained and evenly distributed in the steel.

After dissolution treatment in the temperature range 1000–1180° C., preferably in the range 1050–1150° C., and cooling to room temperature, the matrix of the steel has a predominantly martensitic structure but with a high content of retained austenite. Part of the carbonitrides and of the carbides which also exist in the steel, are dissolved, but 15–30 vol-% fine-grained, evenly distributed vanadium carbonitrides remain in the steel.

The hardness is increased to 58–66 HRC (the hardness within this range depends on the austenitising temperature) through tempering to a temperature within the temperature range 500–600° C. because the retained austenite essentially has been eliminated and been transformed to martensite and by secondary precipitation of in the first place vanadium carbonitrides.

Because, in the first place, of the large content of vanadium carbonitrides, the hardened tempered steel is afforded a very high wear resistance at room temperature, and because of its combination of alloy elements, the steel in other respects is afforded a combination of hardness and toughness which is adequate for the type of cold work tools which has been mentioned in the preamble of this text.

The high speed steel of the invention can be manufactured in the following way. A melt is prepared in a conventional, melt metallurgical way, wherein the melt will get a nitrogen content which does not exceed the maximal content of nitrogen that can be dissolved in the molten steel, while the other alloying elements are adjusted to the contents which are stated in claim 1 or to any of the specified contents which are stated in the dependent claims. From this melt there is formed a metal powder, which can be carried out in a known way trough granulation of a steam of molten metal by means of gas-jets of nitrogen and/or of argon, i.e. according to the technique which forms an initial part of the so called ASProcess (Asea Stora Process). The powder is sieved to a suitable powder gauge, eg. max 250 $\mu$m. Part of the powder is alloyed with nitrogen through solid phase nitriding by means of a nitrogen carrying gas, e.g. nitrogen and/or ammonia gas according to any technique which also may be known. Among known techniques which can be employed may be mentioned for example the technique which is disclosed in SE-C-462 837 or the technique which is described in MPR July, 1986 p. 527–530. Preferably there is used a gas mixture of ammonia and hydrogen gas which is caused to flow through a hot powder bed in a rotating reactor at 550–600° C. The ammonia reacts at this temperature at the surface of the steel powder according to the reacton $2NH_3 \rightarrow 3H_2 + 2N$ (steel). Dissolved nitrogen then will diffuse from the surface into the powder grains. At the exit of the reactor the gas consists of a mixture of nitrogen, hydrogen, and a smaller amount of residual ammonia. The method allows a manufacturing of a nitrided material with a very accurate control of the content of nitrogen. A powder which is alloyed with nitrogen in this or in any other way is mixed with a powder which is not alloyed with nitrogen but which in other respects has preferably the same composition as the nitrogen alloyed powder, so that the mixture will get a desired mean nitrogen content according to the invention. This mixture is charged in sheet capsules which are closed and are hot isostatically compacted according to a known technique, preferably according to the technique which has been mentioned in the foregoing and which is known under the name ASP (Asea Stora Process), for the achievement of a consolidated body of a nitrogen alloyed high speed steel of the invention. This body can be hot worked through rolling and/or forging to desired dimension. During the process of consolidation and at the subsequent hot working, existing variations as far as the content of nitrogen in the starting material for the hot working are concerned, are levelled out so that all parts of the body will get an essentially equally high content of nitrogen.

DESCRIPTION OF PERFORMED EXPERIMENTS

Figure 1:
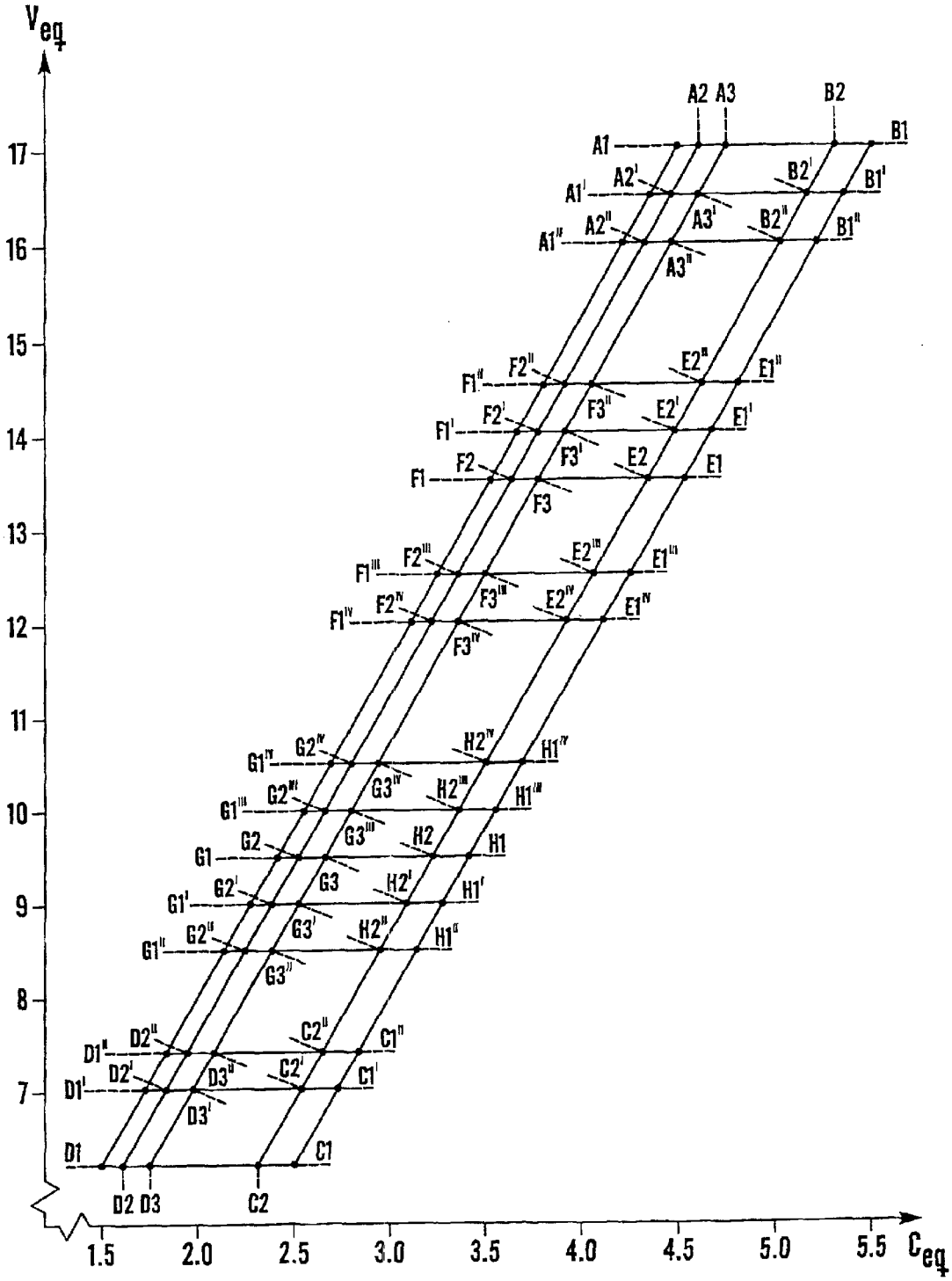
FIG. 1 is a diagram illustrating the contents of those elements of the steel which are the main ingredients in the hard matter of MX-type of the high speed steel of the invention.

The chemical composition expressed in weight-% of the examined steels are given in Table 1 below. Besides the elements which are given in the table, the steel alloys only contained impurities in amounts normally occurring in steel production. Steel alloys Nos. 1–6 are experimental alloys, while alloys Nos. 3–6 are examples of steels according the invention. Steel alloys Nos 7 and 8 are analysed compositions of reference materials, more particularly the commercially available steels ASP® 2023 and ASP® 2053, respectively.

TABLE 1

Chemical composition in weight-% of examined steels

| Steel alloy No. | C | N | Si | Mn | Cr | Mo | W | V | Ceq | Bal. |
|---|---|---|---|---|---|---|---|---|---|---|
| 1 | 0.78 | 0.65 | 0.56 | 0.40 | 3.89 | 4.89 | 6.12 | 3.02 | 1.34 | Fe |
| 2 | 0.42 | 1.04 | 0.41 | 0.31 | 4.05 | 4.95 | 6.39 | 2.93 | 1.31 | " |
| 3 | 1.28 | 1.34 | 0.49 | 0.32 | 4.37 | 3.08 | 4.12 | 7.84 | 2.43 | " |
| 4 | 1.92 | 2.82 | 0.44 | 0.36 | 4.18 | 3.17 | 4.76 | 15.2 | 4.34 | " |
| 5 | 1.26 | 1.39 | 0.52 | 0.28 | 4.26 | 2.97 | 3.30 | 8.20 | 2.45 | " |
| 6 | 2.06 | 2.95 | 0.38 | 0.25 | 4.30 | 2.96 | 3.35 | 15.6 | 4.59 | " |
| 7 | 1.28 | 0.04 | 0.62 | 0.28 | 4.10 | 5.05 | 6.35 | 3.12 | 1.31 | " |
| 8 | 2.45 | 0.05 | 0.53 | 0.31 | 4.17 | 3.08 | 4.25 | 7.94 | 2.49 | " |

$$Ceq = C + \frac{12}{14}N.$$

The starting materials of the experimental alloys Nos. 1–6 consisted of powder manufacturing through gas atomising (granulation) of steel melts produced at a laboratory scale. The melts were atomised by means of nitrogen gas in a powder production apparatus at a laboratory scale, producing a fine powder which was sieved so that a powder fraction having powder grain sizes smaller than 250 $\mu$m was obtained. Part of the powder which was manufactured of different powder alloys was nitrided batchwise by means of a mixture of ammonia and nitrogen gas in a powder bed in a reactor to which the nitriding gas was caused to flow. The temperature in the reactor was about 570° C. The ammonia reacted at said temperature as is was transported through the bed so that there was achieved a mixture of ammonia, nitrogen, and hydrogen gas, which flew through the powder bed. The activity of the nitrogen was very high during these conditions, and the taking up of nitrogen a the steel powder was very good.

Then the nitrogen alloyed powders were mixed with corresponding steel powders which had not been alloyed with nitrogen, in order to form powder mixtures with varying contents of nitrogen. These powder mixtures then were filled in capsules and were compacted hot isostatically at 1150° C. and a pressure of 1000 bar to form consolidated bodies of nitrogen alloyed high speed steel alloys.

After HIP-ing (hot isostatic pressing) the blanks had a diameter of about 130 mm and a length of about 600 mm. The materials were forged, whereafter they were soft annealed, hardened and tempered. Then the materials were analysed with reference to their chemical composition, as has been shown in Table 1 above.

During initial studies it was stated that steels Nos. 1 and 2 did not achieve desired properties, wherefore they were not studied more in detail. The initial studies, on the other hand, showed promising results as far as the steels Nos. 3–6 were concerned. Among these steels, the materials made of the steel alloys Nos. 5 and 6 were studied more closely and were subjected to mechanical tests, wear tests, un-notched impact tests, and metallographic structure studies. Also the reference materials which were made of the steel alloys Nos. 7 and 8 were subjected to said materials tests.

The results of the forging tests are given in Table 2.

TABLE 2

Results of forging tests. Initial diameter about ϕ 130 mm.

| Material | Step 1: forged to | Step 2: forged to | Remarks |
|---|---|---|---|
| Steel No.5 | ϕ = 60 mm | 30 × 30 mm | Forgeable in both steps |
| Steel No.6 | ϕ = 55 mm | 60 × 65 × 15 mm | Forgeable in step 1. Difficult to forge in step 2. |

Steel No. 5 could be forged without problems, while steel No. 6, which was substantially more alloyed, exhibited a significantly impaired forgeability. In the second step, the material cracked and fell partly into pieces. The reason for this may be due to the high amount of hard matter of MX-type of the material; about a third of the volume of the material.

Then the influence of the austenitising temperature on the hardness of steels No. 5 and No. 6 with and without deep cooling was examined. The follow mg results were achieved.

TABLE 3

Hardness, HRC, of examined steels after hardening

| Material | Austenitising treatment 1000° C./30 min. | 1050° C./30 min. | 1100° C./15 min. | 1150° C./10 min. |
|---|---|---|---|---|
| Steel No. 5 Hardened, cooled in air | 65.5 | 66.0 | 66.9 | 66.5 |
| Steel No. 5 Hardened, deep cooled | 65.9 | 66.5 | 66.9 | 67.1 |
| Steel No. 6 Hardened, cooled in air | 67.7 | 66.5 | 62.4 | 60.0 |
| Steel No. 6 Hardened, deep cooled | 69.8 | 69.7 | 69.2 | 68.5 |

As is apparent from the table, it is only steel No. 6 which after hardening from 1000° C. gains a significant hardness increase after deep cooling.

Figure 2:
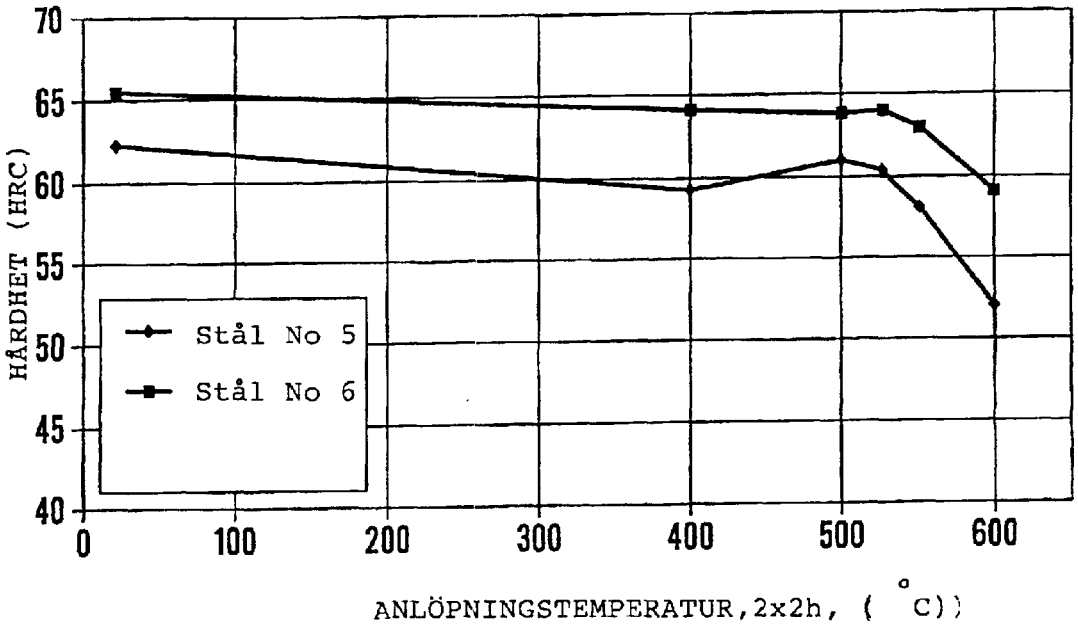
FIG. 2 is a diagram illustrating the hardness versus different tempering temperatures of a couple of steels according to the invention.

For the subsequent investigation of the hardness in dependency of different tempering temperatures materials were chosen which had been hardened from 1000° C. for 30 minutes and cooled to room temperature. The results are shown in FIG. 2. As is apparent from this figure, the hardness of steel No. 5 as well as of No. 6 is slightly decreased up to a tempering temperature of 500–520° C. but is strongly decreased at higher tempering temperatures.

Then the impact toughness was examined in terms of impact energy for un-notched test specimens. The specimens were taken in the longitudinal direction of the forged materials. The materials had been hardened by austenitising at 1000° C./30 min followed by cooling to room temperature, and had been tempered 2 times at 525° C. for 2 hours with intermediate cooling in air. Hardness and impact energy of the experimental materials are given in Table 4. Also the measured values of the reference materials, steels No. 7 and No. 8 after hardening from 1000° C./30 min and 1075° C./30 min, respectively, +tempering, 560° C./3×1 hour are given in the table.

TABLE 4

Hardness and impact energy of the experimental materials

| Material | Hardness, HRC | Impact energy, J |
|---|---|---|
| Steel No. 5 | 62.0 | 18 |
| Steel No. 6 | 64.5 | 8 |
| Steel No. 7 | 62.0 | 55 |
| Steel No. 8 | 62.0 | 45 |

The nitrided experimental materials No. 5 and No. 6 exhibit low fracture energies in comparison with the reference materials No. 7 and No. 8 which were taken from a full scale production. The reason for this can be due to the much higher contents of hard matter in the experimental materials and also to the fact that the experimental materials, which were manufactured at a laboratory scale, have extraordinary high contents of oxygen, 495 ppm and 570 ppm, respectively, as compared with 50 ppm which is a more typical oxygen content in production materials. However, the measured impact energies of the experimental materials may be acceptable in view of those applications for which the high speed steel of the invention are intended particularly in consideration of the higher impact energy which can be expected at a full scale production of the materials.

For the evaluation of the wear resistance of the steels, particularly the resistance of the materials to adhesive wear, tools were made for cold working of sheets of austenitic stainless steel for pump housings, more particularly tools for deep drawing of pump, rotor sleeves. The press, in which the tools were mounted, had a number of separate press stations, here denominated station 1 and 2. Station 2 was a station which by experience gives a stress which in terms of adhesive wear is about 3 times as large as in station 1. The working part, which was made from the examined materials, cot of a ring having an outer diameter of 90 mm an inner diameter of 64 mm, and a height of 46.5 mm The results are stated in Table 5.

TABLE 5

Working life of the tools (number of pressings) of different tool materials used for deep pressing of sleeves of stainless steel

| Material | Press station | Surface treatment | Number of pressings |
|---|---|---|---|
| Steel No. 5 | 1 | None | >1.500.000* |
| Steel No. 6 | 2 | " | >700.000* |
| Steel No. 7 | 1 | " | 51160** |
| Steel No. 7 | 2 | " | 18000** |

1 When the results were evaluated.
**Whereafter the tool was worn out.

The press result of the nitrogen alloyed steel No. 5 of the invention implied an increase of the working life of the tool of at least 30 times as compared with the reference material No. 7. The tool then still was operative in the press and the life time test continued. Also the material No. 6 of the invention had a superior wear resistance, i.e. at least 40 times longer life time than the reference material No. 7. In this connection it should also be notified that the lower impact energy of the materials of the invention in comparison with the reference materials did not cause any problems in the very demanding application.

Figure 3:
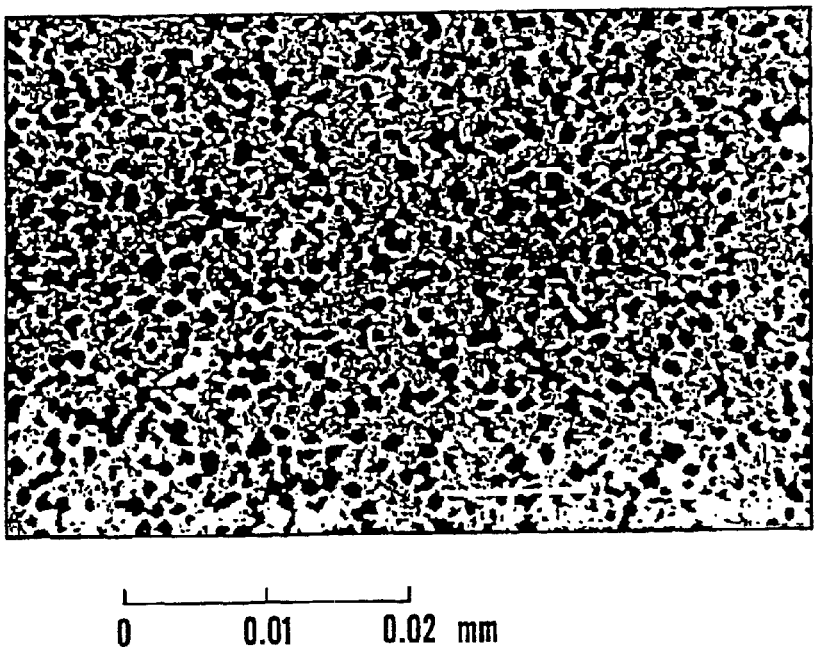
FIG. 3 is a micro photograph showing the microstructure of a steel of the invention after hot working but before hardening

The microstructure of the materials were examined by scanning electron microscope (SEM). FIG. 3 shows the microstructure of steel No. 6 after HIP-ing and subsequent forging. The vanadium carbonitrides are visible in the figure as black, evenly distributed islands in the grey austenite. Structure examinations of steel No. 5 showed a similar distribution of the vanadium carbonitrides. The only thing which from a structural point of view differs the two materials 5 and 6 of the invention from each other is that steel No. 6 contains about 70% more of the MX-phase than steel No. 5. The majority of the carbonitrides had a diameter of between 1–2 $\mu$m. Moreover, in both steel No. 4 and No. 5 there was found a minor phase portion of M6C-carbides, which had the shape of lamellar precipitations with an extension of about 2–3 $\mu$m but with very small thickness; a thickness of one or a few tenth of a $\mu$m.

What is claimed is:

1. A powder metallurgy manufactured high speed steel with a high content of nitrogen in the form of a body formed through consolidation of alloyed metal powder, wherein the high speed steel, with reference to its chemical composition contains in weight-%

1–2.5 C

1–3.5 N 0.05–1.7 Mn 0.05–1.2 Si

3–6 Cr

2–5 Mo 0.5–5 W 6.2–17 (V+2 Nb)

balance iron and unavoidable impurities in normal amounts, and wherein the amount of, on one hand, the carbon equivalent, Ceq, expressed as $$Ceq = C + \frac{12}{14}N,$$

and, on the other hand, the vanadium equivalent, Veq, expressed as Veq=V+2 Nb, are balanced relative to each other such that the amounts of said elements, expressed in terms of said equivalent, will lie within the area A1-B1-Cl-D1-A1 in the system of co-ordinates in FIG. 1, in which the Ceq/Veq-co-ordinates of the points A1-D1 are

A1: 4.5/17

B1: 5.5/17

C1: 2.5/6.2

D1: 1.5/6.2 the high speed steel with reference to its structure, in the hardened and tempered condition of the steel, containing 12–40 vol-% of hard matter consisting of MX-particles, which are evenly distributed in the matrix of the steel, M in said matter of MX-type essentially consisting of vanadium and/or niobium, and X consisting of 30–50 weight-% carbon and 50–70 weight-% nitrogen.

2. A high speed steel according to claim 1, wherein the co-efficients of the carbon and vanadium equivalents lie within the area A2-B1-C1-D2-A2 in the system of co-ordinates in FIG. 1, in which the Ceq/Veq co-ordinates of the points A2 and D2 are:

A2:4.6/17

D2:1.6/6.2.

3. A high speed steel according to claim 2, wherein the co-efficients of the contents of carbon and vanadium equivalents lie within the area A3-B1-C1-D3-A3 in the system of co-ordinates in FIG. 1 in which the Ceq/Veq co-ordinates of the points A3 and D3 are:

A3:4.75/17

D3:1.75/6.2.

4. A high speed steel according to claim 1, wherein the co-efficients of the contents of carbon and vanadium equivalents lie within the area A2-B2-C2-D2-A2 in the system of co-ordinates in FIG. 1 in which the Ceq/Veq co-ordinates of the points B2 and C2 are:

B2:5.3/17

C2:2.3/6.2.

5. A high speed steel according to claim 3, wherein the coefficients of the contents of carbon and vanadium equivalents lie within the area A3-B2-C2-D3-A3 in the system of co-ordinates in FIG. 1.

6. A high speed steel according to claim 1, wherein it contains 6.2–9.5 (V+2 Nb), and that the co-efficients of the contents of the carbon and vanadium equivalents lie within the area G1-H1-C1-D1-G1, in which the Ceq/Veq co-ordinates of the points G1 and H1 are:

G1:2.4/9.5

H1:3.4/9.5.

7. A high speed steel according to claim 6, wherein the co-efficients of the contents of the carbon and vanadium equivalents lie within the area G2-H1-C1-D2-G2 in the system of co-ordinates in FIG. 1, in which the Ceq/Veq co-ordinate of the corner point G2 is 2.5/9.5.

8. A high speed steel according to claim 7, wherein the co-effcients of the contents of the carbon and vanadium equivalents lie within the area G2-H2-C2-D2-G2 in the system of co-ordinates in FIG. 1, in which the Ceq/Veq co-ordinate of the corner point H2 is 3.2/9.5.

9. A high speed steel according to claim 7, wherein the co-efficients of the contents of the carbon and vanadium equivalents lie within the area G3-H1-C1-D3-G3 in the system of co-ordinates in FIG. 1, in which the Ceq/Veq coordinate of the corner point G3 is 2.65/9.5.

10. A high speed steel according to claim 9, wherein the co-efficients of the contents of the carbon and vanadium equivalents lie within the area G3-H2-C2-D3-G3 in the system of co-ordinates in FIG. 1.

11. A high speed steel according to claim 6, wherein it contains 7–9 (V+2 Nb).

12. A high speed steel according to claim 6, wherein it contains 7.4–8.6 (V+2 Nb).

13. A high speed steel according to claim 1, wherein it contains 13.5–17 (V+2 Nb) and that the co-ordinates of the carbon and vanadium equivalents lie within the area A1-B1-E1-F1-A1 in the system of co-ordinates in FIG. 1, in which the Ceq/Veq co-ordinates of the corner points E1 and F1 are:

E1:4.55/13.5

F1:3.55/13.5.

14. A high speed steel according to claim 13, wherein the co-ordinates of the contents of the carbon and vanadium equivalents lie within the area A2-B1-E1-F2-A2 in system of co-ordinates in FIG. 1, in which the Ceq/Veq co-ordinate of the corner point F2 is 3.65/13.5.

15. A high speed steel according to claim 14, wherein the co-ordinates of the contents of the carbon and vanadium equivalents lie within the area A3-B1-E1-F3-A3 in system of co-ordinates in FIG. 1, in which the Ceq/Veq coordinate of the corner point F3 is 3.8–13.5.

16. A high speed steel according to claim 14, wherein the co-ordinates of the contents of the carbon and vanadium equivalents lie within the area A2-B2-E2-F2-A2.

17. A high speed steel according to claim 15, wherein the co-ordinates of the contents of the carbon and vanadium equivalents lie within the area A3-B2-E2-F3-A3 in the system of co-ordinates in FIG. 1.

18. A high speed steel according to claim 13, wherein it contains 14–16.5 (V+2 Nb).

19. A high speed steel according to claim 13, wherein it contains 14.5–16 (V+2 Nb).

20. A high speed steel according to claim 1, wherein it contains 9.5–13.5 (V+2 Nb), and that the co-efficients of the contents of the carbon and the vanadium equivalents lie within the area F1-E1-H1-G1-F1.

21. A high speed steel according to claim 20, wherein the co-efficients of the contents of the carbon and vanadium equivalents lie within the area F2-E1-H1-E2-F2.

22. A high speed steel according to claim 21, wherein the co-efficients of the contents of the carbon and vanadium equivalents lie with in the area F3-E1-H1-G3-F3.

23. A high speed steel according to claim 21, wherein the co-efficients of the contents of the carbon and vanadium equivalents lie with in the area F2-E2-H2-G2-F2.

24. A high speed steel according to claim 23, wherein the co-efficients of the contents of the carbon and vanadium equivalents lie with in the area F3-E2-H2-G3-F3.

25. A high speed steel according to claim 20, wherein it contains 10–12.5 (V+2 Nb).

26. A high speed steel according to claim 20, wherein it contains 10.5–12 (V+2 Nb).

27. A high speed steel according to claim 1, wherein it contains 0.1–1.2% Si.

28. A high speed steel according to claim 1, wherein it contains max. 1.0 Mn.

29. A high speed steel according to claim 1, wherein it contains 3.5–5 Cr.

30. A high speed steel according to claim 1, wherein it contains at least 2.5 Mo and at least 2.0 W.

31. A high speed steel according to claim 1, wherein the contents of each of Mo and W does not exceed 5%.

32. A high speed steel according claim 30, wherein $$\%Mo_{eq} = \%Mo + 5\frac{W}{2}$$

lies within the range 2.25–7.5%.

33. A high speed steel according to claim 6, wherein the steel in the as hardened and tempered condition contains 14–23 vol-% hard matters consisting of MX-partricles, evenly distributed in the matrix of the steel.

34. A high speed steel according to claim 13, wherein the steel in the as hardened and tempered condition contains 23–38 vol-% hard matters consisting of MX-particles evenly distributed in the matrix of the steel.

35. A high speed steel according to claim 20, wherein the steel in the as hardened and tempered condition contains 18–27 vol-% hard matters consisting of MX-particles, evenly distributed in the matrix of the steel.

36. A high speed steel according to claim 1, wherein it in the as hardened and tempered condition contains 3–5 vol-% $M_6C$-carbides, where M is substantially Mo and W.

37. A high speed steel according to claim 1, wherein it besides MX-carbonitrides where M substantially is V also contains $M_6C$-carbides, where M is substantially Mo and W, the total amount of $M_6C$-carbides corresponding to 10–30% of the total content of ($MX+M_6C$)-phase.

38. A high speed steel according to claim 1, wherein the as hardened and tempered condition contains 0.40–0.60%, of carbon which is dissolved in the matrix.

39. A high speed steel according to claim 27, wherein it contains max 0.7% Si.

40. A high speed steel according to claim 28, wherein it contains max 0.5 Mn.

41. A high speed steel according to claim 29, wherein it contains max 4.5 Cr.

42. A high speed steel according to claim 30, wherein it contains at least 2.5 W.

43. A high speed steel according to claim 42, wherein it contains at least 3.0 W.

44. A high speed steel according to claim 31, wherein the content of each of No and W does not exceed 4%.

45. A high speed steel according to claim 32, wherein $$\%Mo_{eq} = \%Mo + 5\frac{W}{2}$$

lies within the range 4–6%.

46. A high speed steel according to claim 38, wherein the as hardened and tempered condition contains 0.47–0.54% of carbon which is dissolved in the matrix.

* * * * *